United States Patent [19]

Von Hapsburg

[11] 4,280,315

[45] Jul. 28, 1981

[54] BULK LOADER

[76] Inventor: D. Lewis Von Hapsburg, 138 Alta St., Arcadia, Calif. 91006

[21] Appl. No.: 61,362

[22] Filed: Jul. 27, 1979

[51] Int. Cl.[3] ..... B65B 67/04; B65B 67/12

[52] U.S. Cl. ..... 53/473; 53/390; 141/10; 141/390

[58] Field of Search ..... 53/390, 261, 262, 459, 53/473; 248/99, 101; 141/390, 10

[56] References Cited

U.S. PATENT DOCUMENTS

| | | | |
|---|---|---|---|
| 176,555 | 4/1876 | Scholfield | 141/390 X |
| 1,211,278 | 1/1917 | Blum | 141/390 |
| 2,649,966 | 8/1953 | Johnston | 248/99 X |
| 3,722,561 | 3/1973 | O'Leary et al. | 248/99 |
| 3,997,072 | 12/1976 | Guth | 248/101 X |
| 4,014,157 | 3/1977 | Pearce | 53/390 X |
| 4,139,029 | 2/1979 | Geraci | 53/390 X |

*Primary Examiner*—Horace M. Culver

*Attorney, Agent, or Firm*—Stephen J. Koundakjian

[57] ABSTRACT

Disclosed is an improved apparatus for facilitating the filling of flexible containers.

The apparatus consists of a substantially rigid, frustoconical tubular structure, somewhat smaller, in transverse dimension, than the transverse dimension of the flexible container to be filled. Means are provided for holding the apparatus when material is loaded through it into the container, and longitudinal grooves are provided in the outer surface of the apparatus to permit the release of air from the container as it is being filled.

11 Claims, 5 Drawing Figures

BULK LOADER

BACKGROUND OF INVENTION

A. Field of Invention

This invention relates to means for facilitating the loading of bulk solids into flexible containers.

B. Description of Prior Art

Floods occur during the rainy season or Spring thaw in most parts of the world. During flooding, public and private property is commonly protected from water damage by the creation of temporary embankments around the property to prevent the intrusion of flood waters. Frequently, this is accomplished by creating a wall of sandbags—burlap bags filled with sand, gravel or rock, or some combination thereof. These empty sandbags are normally stored in police and fire stations in flood-prone areas, and are filled with locally available materials as and when an acute flood danger is present.

At such times, professional and volunteer help normally fill thousands of these sandbags with whatever material is available and place them in the embankment as quickly as possible, since there is generally little warning when the flood danger arises. Typically, filling a sandbag consists in one worker raising the empty bag and spreading its opening, while another worker rapidly shovels the material into it, filling it approximately half way. At that point, one or the other of these workers, or a third worker, takes the partially filled bag, which may or may not be tied off to prevent escape of its contents, and adds it to the top of the embankment being constructed.

It can easily be seen that these bags could be filled much more rapidly if each worker could fill these bags alone, without the assistance of someone to hold the bag. However, since the bags are limp and lacking in any structure, some means must be provided to hold the bag open, so that it can accept each shovelful of material.

Obviously, a single worker could hold the bag with one hand while attempting to shovel with the other, but this would be rather inefficient.

Various sorts of wire hoop devices have been used in the past. Such devices are generally utilized by opening the bag upward and wiring or clipping the open end of the bag to the hoop, the latter being attached to some sort of structure which keeps the open end of the bag raised above the ground.

While such devices may work quite well during the first few shovelfuls of sand, dirt or rock which are loaded into the bag, the increasing weight of the bag eventually pulls it away from the hoop and down to the ground, or even collapses the entire structure.

Obviously, one could conceive of much more complex apparatus for holding bags and causing them to be filled in a conveyor-like fashion with automatic machinery. However, such devices would be somewhat expensive, difficult to transport to the sometimes rather inaccessible spot where they are to be used and would require a source of energy which might not be available in a flood crisis.

A simple, inexpensive apparatus which would permit a single worker to fill sandbags with a minimum of effort would, therefore, be advantageous.

Similarly, a simple, reliable apparatus to enable homeowners, professional gardeners, maintenance men, construction workers, and the like, to easily fill bags or trash containers would be quite useful.

SUMMARY OF THE INVENTION

Accordingly, it is an object of this invention to provide an apparatus which will permit a single worker to readily load soil, sand, gravel, rocks, leaves, trash, cement, and/or other bulk materials, and/or any combination thereof into sandbags, trash bags or other flexible containers without the necessity of a second worker and/or complex apparatus to hold the container open and to facilitate loading.

Briefly, the apparatus of the present invention comprises a substantially rigid, tubular, frusto-conical structure. The upper portion of the structure is fitted with a raised rim which extends around at least a substantial portion of the circumference thereof, to facilitate gripping of the apparatus. The lower end of the structure is at least somewhat smaller in cross-sectional area than the upper portion, and the cross-sectional area of the apparatus generally decreases from the base of the aforementioned rim to the lower end of the apparatus. Longitudinal grooves are cut into the outer surface of the apparatus from a point somewhere below the holding rim to a point at or near the lower end of the apparatus, to facilitate the flow of air outward from the container as it is being filled.

The internal volume of the apparatus of the present invention is usually—though not necessarily—comparable to the fill volume of the container.

In use, the lower end of the apparatus is inserted into the empty container. The open end of the container is pulled up over and around a portion of the apparatus, until it forms a sort of covering around it. The apparatus, covered by the empty, open container is placed on the ground, and the operator fills the apparatus with whatever material—sand, dirt, leaves, trash, etc.—he wishes to fill it. When the apparatus is full, or nearly so, he holds the lip of the container with one hand and gently pulls the apparatus out of it. As the apparatus is withdrawn from the container, the contents of the apparatus uniformly fill it.

DETAILED DESCRIPTION OF THE PREFERRED EMBODIMENT

Figure 1:
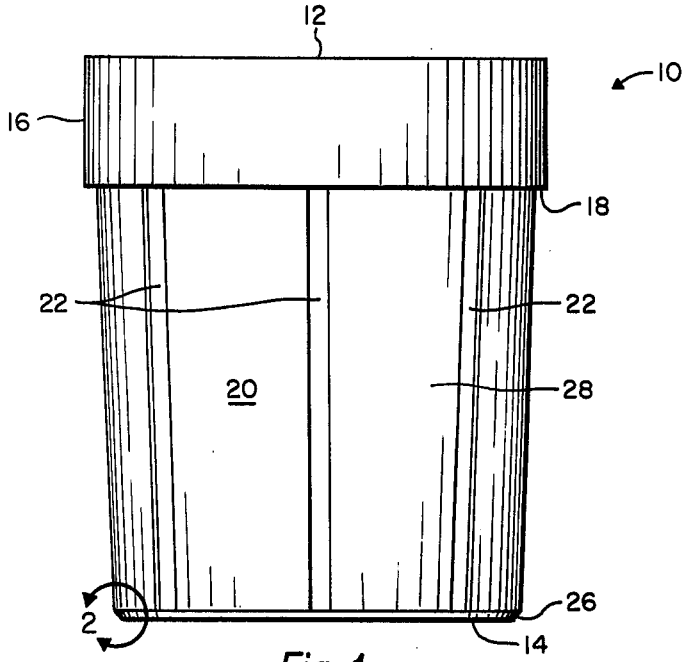
FIG. 1 is a side elevation view of an apparatus according to the present invention.
Figure 2:
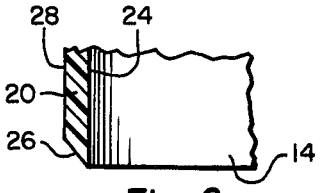
FIG. 2 is a sectional view of a portion of the lower end of the apparatus shown in FIG. 1.

As shown in FIG. 1, the bulk loader 10 comprises, in essence, a tubular shell of material having an upper end 12 and a lower end 14, each more or less transverse, in area, to the longitudinal axis of the bulk loader.

Extending longitudinally downward from the upper end 12 is a raised rim 16 which extends circumferentially around the bulk loader 10. While in the drawing, the raised rim is shown to extend completely around the bulk loader, this is not absolutely necessary, so long as a portion of it covers a substantial portion of the bulk loader. The purpose of the raised rim is two-fold. First, it lends strength to the overall bulk loader without unduly reducing its flexibility. Secondly, the lower lip 18 of the raised rim provides a grip for the operator when removing the bulk loader from the filled container. Clearly, then, it is advantageous to cause the raised rim to extend in an unbroken fashion around the entire circumference of the bulk loader. But this is not necessary, and many of its advantages could be realized if the raised rim were implemented in a series of arc-like sections around the circumference.

The body 20 of the bulk loader 10 comprises the remainder of the shell of the entire bulk loader, and extends from the lower lip 18 of the raised rim 16 longitudinally to the lower end 14 of the bulk loader. The purpose of the body is, of course, to create the internal volume of the bulk loader, into which the material is loaded for deposit into the container. The body should provide a good deal of rigidity, yet it should be somewhat flexible and lightweight, without sacrificing strength and ruggedness.

A number of longitudinal grooves 22 are provided in the outer surface 28 of the body 20 of the bulk loader 10, extending from the lower lip 18 of the raised rim 16 to nearly the lower end 14 of the bulk loader. The purpose of these grooves is two-fold. First, they provide a means of escape of the air inside the container as it is being filled through the bulk loader. These grooves thus permit the outer circumference of the body of the bulk loader to be nearly the same as the inside circumference of the stretched container for a tight fit of the container around the bulk loader. This tight fit further facilitates the filling of the container through the bulk loader, as the container will now remain fully open (because it will tightly adhere to the outside of the body of the bulk loader) during the entire filling operation.

The secondary purpose of the grooves 22 in the body 20 is to somewhat reduce the amount of material needed for the construction of the bulk loader 10, thus decreasing its weight and, not incidentally, the cost of its manufacture.

It should be mentioned, at this point, that in the preferred embodiment of the present invention, the inner surface 29 of the bulk loader 10 is smooth and continuous throughout, thus facilitating the smooth flow of material into and through it and the easy removal of the bulk loader from the container when it is filled.

Near the lower end 14 of the bulk loader 10 is a chamfer 26. This chamfer may be eliminated, but it is advantageous in facilitating insertion of the bulk loader 10 into the container and easy removal from it. In the preferred embodiment of the present invention, a simple 45° chamfer is provided from the outer surface 28 of the body 20 to its inner surface 29 at the lower end of the bulk loader.

Figure 3:
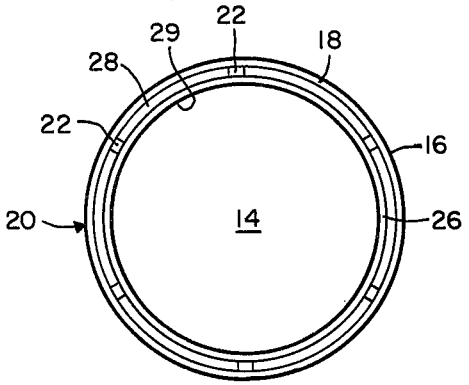
FIG. 3 is a plan view of the apparatus shown in FIG. 1, viewed from the lower end to the upper end.
Figure 4:
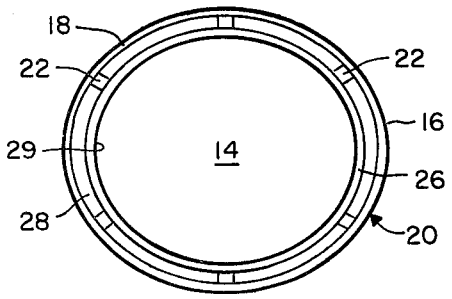
FIG. 4 is a plan view, similar to the view shown in FIG. 3, but of an alternative embodiment of the present invention.

As shown in FIG. 3, the transverse section of the bulk loader 10 may be a circle. Likewise, as shown in FIG. 4, it may be an ellipse. Furthermore, it might be any sort of closed curve. In fact, there is no real necessity that the transverse section must be curved at all, although it can easily be seen that having a curved outer surface 28 and inner surface 29 of the bulk loader will permit easier insertion and withdrawal from the container than would a bulk loader having, for example, a hexagonal or octagonal transverse section.

Figure 5:
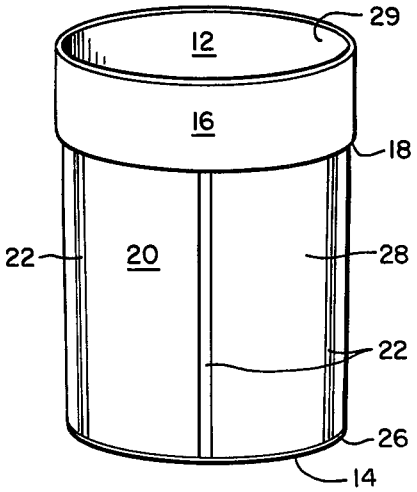
FIG. 5 is a perspective view of an embodiment of the present invention.

Whatever the actual shape of the transverse sections, the transverse dimensions should generally decrease somewhat from the region of the lower lip 18 of the raised rim 16 downward to the lower end 14. There is no need that these dimensions be monotonically decreasing all the way from the lower lip to the lower end, although this would further facilitate easy insertion and withdrawal of the bulk loader from the container. For this reason, the transverse dimensions of the body 20 of the bulk loader are monotonically decreasing from the lower lip to lower end, in the preferred embodiment of the present invention, as shown in FIGS. 1, 3 and 5.

In selecting the material from which the bulk loader 10 of the present invention is to be constructed, one must consider that the device must be reasonably rigid, to support the forces of the materials being dumped into it, yet somewhat flexible, to avoid brittle cracking or tearing when it is being used. Furthermore, the overall device must be fairly lightweight, without sacrificing strength and ruggedness, and must be fairly inexpensive to manufacture, since, for example, many of them would be required in the ordinary flood protection operation. Additionally, since the loaded material must slide freely through the bulk loader, and the apparatus must be easy to insert into the container and to withdraw from it, it should be constructed of a smooth, self-lubricating material.

I prefer to construct the bulk loader 10 of the present invention from extruded polyurethane plastic or some other plastic, such as polypropylene, polyethylene or nylon, which satisfies the above criteria. Lightweight metals, such as aluminum, could be used, although a metallic bulk loader according to the present invention would tend to buckle in time, and it would be initially more difficult (and, thus, more expensive) to manufacture than a plastic one.

The bulk loader 10 could be molded or extruded in one piece, or the raised rim 16 and the body 20 could be separately fabricated and then fitted together, although the former is believed to produce a more durable final product. Of course, those elements could be fabricated of different materials and then fitted together in a conventional manner, if this is desired.

The dimensions of the bulk loader 10 of the present invention are, of course, dictated by the dimensions of the container to be filled. Normally, it is desirable to provide an internal volume of the bulk loader of approximately one-half of the maximum capacity of the container. If this volume ratio is desired, in the case of the ordinary burlap bag used in sandbagging operations, this would dictate, in the case of a bulk loader of circular cross-section throughout, an upper end 12 having an internal diameter of approximately 12", a lower end 14 having an internal diameter of approximately 11" and a longitudinal dimension (from the upper end to the lower end) of approximately 15".

The width of the raised rim 16 (i.e., the distance from the upper end 12 of the bulk loader 10 to the lower lip 18 of the raised rim) is not critical, although I have found that, with the aforementioned dimensions, a width of approximately 3½" provides a good degree of overall strength to the bulk loader without unduly increasing its weight. Furthermore, I have found that providing a raised rim of as little as ¼" to ½" thickness provides a sufficient gripping surface for the operator at the lower lip of the rim.

The depth of the grooves 22 is likewise not very critical, although, of course, if they are cut too deeply this will greatly reduce the overall strength of the bulk loader 10. If, for example, the body 20 of the bulk loader is constructed of material ¼" thick (a reasonable dimension), the grooves could be approximately ⅛" deep. The width of the grooves is likewise not very critical, nor is the number of grooves placed around the circumference of the body. As shown in the drawing, approximately six (6) evenly placed grooves, each approximately ½" wide, will be adequate for the aforementioned purposes.

Having now thoroughly described the bulk loader 10 of the present invention, according to its preferred embodiments, I will now briefly discuss a few of its applications.

In the normal sandbagging operation, the lower end 14 is inserted into the sandbag, and the latter is pulled up over the outer surface 28 of the bulk loader 10 in a rather snug fit (determined by adjusting the dimensions of the bulk loader to the "stretched" dimensions of a standard sandbag.) Preferably, the bulk loader is sized so that the sandbag is sufficiently large, relative thereto, that a portion of its open end can be pulled over the top of the bulk loader and tucked down into the upper end 12 of the bulk loader for even more secure holding of the sandbag during the filling operation. This, however, is by no means absolutely necessary, and the sandbagging operation works quite well if the bulk loader is even rather loosely placed into the open sandbag.

As stated above, the operator shovels the material into the bulk loader 10 until the sandbag is filled. He may then grip the raised rim 16 and pull the bulk loader up somewhat and load additional material into it to replace the material which would have fallen through its lower end 14 into the sandbag. Likewise, he may simply remove the bulk loader entirely, thus partially or (depending on the relative sizes of the bulk loader and the sandbag) wholely filling the bag.

It should be noted, at this point, that the provision of the raised rim 16 permits the bulk loader 10 of the present invention to be used under very poor lighting conditions, since the operator can easily grip the apparatus without having to search for a conventional handle, which might be difficult under such conditions. The provision of this raised rim in conjunction with the other elements of the present invention is considered a particularly advantageous feature.

It should be pointed out, again, that there is no reason why the bulk loader 10 of the present invention must necessarily be restricted for use in sandbagging operations. Clearly, by adjusting the size and shape of the apparatus appropriately to the particular application, it could be used by home or professional gardeners for filling trash bags, and for many other similar operations—all of which would be rather difficult and frustrating for a single operator without the use of the bulk loader of the present invention.

I claim:

1. The apparatus for facilitating loading of bulk materials into a flexible container having an opening, comprising a solid, one-piece shell-like structure having:

a longitudinal axis;

an upper end;

a lower end, said upper end having a cross-sectional area greater than that of said lower end; and a gripping rim proximate to said upper end, said gripping rim extending around the entire outer circumference of said shell-like structure, said rim being substantially wider, as measured longitudinally along the shell-like structure, than its thickness, as measured radially from said longitudinal axis;

said shell-like structure provided, on its outer surface, with a plurality of longitudinal grooves, said grooves extending toward said upper end from a point in proximity to said lower end.

2. Apparatus as in claim 1, wherein all transverse sections of said shell-like structure comprise closed curves.

3. Apparatus as in claim 2, wherein said transverse sections are circular throughout the length of said shell-like structure.

4. Apparatus as in claim 2, wherein said transverse sections are substantially elliptical throughout the length of said shell-like structure.

5. Apparatus as in claim 1, wherein said cross-sectional area monotonically decreases, along the longitudinal axis of said shell-like structure, from said upper end to said lower end.

6. Apparatus as in claim 1, wherein said longitudinal grooves are substantially evenly spaced about the circumference of said outer surface.

7. Apparatus as in claim 1, wherein the lower end of said shell-like structure is chamfered.

8. Apparatus as in claim 2, wherein the lower end of said shell-like structure is chamfered.

9. The method of filling a flexible container having an opening, comprising:

providing an apparatus, comprising a solid, one-piece shell-like structure having:

a longitudinal axis;

an upper end;

a lower end, said upper end having a cross-sectional area greater than that of said lower end; and a gripping rim proximate to said upper end, said gripping rim extending around the entire outer circumference of said shell-like apparatus, said rim being substantially wider, as measured longitudinally along the shell-like structure, than its thickness, as measured radially from said longitudinal axis;

said shell-like structure provided, on its outer surface, with a plurality of longitudinal grooves, said grooves extending toward said upper end from a point in proximity to said lower end, the maximum outer circumference of said shell-like structure being smaller than the circumference of the opening of said container;

inserting said lower end into said container through said opening;

pouring bulk material through said apparatus into said container; and removing said apparatus from said container.

10. The method as in claim 9, wherein the maximum outer circumference of said shell-like structure is almost equal to the circumference of the opening of said container.

11. The apparatus for facilitating loading of bulk materials into a flexible container having an opening, comprising a solid, one-piece shell-like structure having:

a longitudinal axis;

an upper end;

a lower end;

a gripping rim proximate to said upper end, said gripping rim extending around the entire outer circumference of said shell-like structure, said rim being substantially wider, as measured longitudinally along the shell-like structure, than its thickness, as measured radially from said longitudinal axis;

the transverse sections of said shell-like structure being substantially circular throughout the length of said shell-like structure, the area of said transverse sections monotonically decreasing from the proximity of said gripping rim to said lower end;

said shell-like structure provided, on its outer surface, with a plurality of longitudinal grooves extending toward said upper end from a point in proximity to said lower end;

the lower end of said shell-like structure being chamfered.

* * * * *